United States Patent [19]

Johnstun

[11] 4,239,399

[45] Dec. 16, 1980

[54] PORTABLE SHRINK TUBING MARKER GUN

[76] Inventor: Dick E. Johnstun, 27472 Via Olmo, Misson Viejo, Calif. 92675

[21] Appl. No.: 14,049

[22] Filed: Feb. 22, 1979

[51] Int. Cl.[3] ..... B41J 1/52

[52] U.S. Cl. ..... 400/128; 400/134.5; 400/613

[58] Field of Search ..... 400/128, 134.5, 134.4, 400/134.6, 613; 101/37

[56] References Cited

U.S. PATENT DOCUMENTS

| | | | |
|---|---|---|---|
| 2,186,788 | 1/1940 | Olson | 101/37 X |
| 3,276,559 | 10/1966 | DeMan | 400/134.5 |
| 3,311,208 | 3/1967 | Pedersen | 400/134.5 |
| 3,650,059 | 3/1972 | Johnson | 400/134 X |
| 3,757,919 | 9/1973 | Pedersen | 400/134.5 |
| 3,912,064 | 10/1975 | Bluem et al. | 400/134.6 |
| 4,041,863 | 8/1977 | Mullen et al. | 400/236 X |

*Primary Examiner*—Clifford D. Crowder
*Attorney, Agent, or Firm*—William H. Maxwell

[57] ABSTRACT

A portable shrink tubing marking device comprised of a hand held grip mechanism to transfer printing material from a tape supply thereof onto a preformed roll supply of flattened tubing, utilizing a character selection and cut-off wheel and dual cartridges carrying the supplies of shrink tubing and printing tape.

30 Claims, 11 Drawing Figures

PORTABLE SHRINK TUBING MARKER GUN

BACKGROUND

The marking of various labels and the like is well known, and especially the marking of shrink tubing to be applied to electrical wiring whereby identification can be made in the form of characters imprinted thereon. However, the prior art application is limited to the installation of prepared tubing with the imprinting done upon typewriters and/or special imprinting devices which are not portable, and which require the logistics of requisition, production and delivery rather than in-the-field or on-the-job preparation and application of said identification tubing. Therefore, it is a general object of this invention to provide a portable marker for the application of indicia upon shrink tubing, to be used by in-the-field or on-the-job technicians.

This invention is concerned with the application of printed shrink tubing onto the end portions of wiring that requires identification. The number of characters needed for identification varies greatly and consequently the length of the tubing changes accordingly. It is thin-walled cross linked polymer tubing or the like, with which this invention is concerned, and which is available in soft initially cured roll form of large cross sectional diameter, and which is to be subjected to heat curing that reduces its diameter for constriction onto the wires to be identified, as circumstances require. The opacity and/or color of the tubing can vary, a white opaque tubing being widely employed. A problem arises in the imprinting of indicia onto such tubing, the roundness or cylindrical convexity making it difficult to imprint complete legible characters thereon. Heretofore, flattened cores or fillers have been inserted into the tubing to substantially occupy the interior thereof and thereby flatten the same preparatory to imprinting; but this process has its limitations to short lengths of tubing and precludes continuous lengths in the supply thereof. I have discovered that a partial shrink of the tubing while held flattened and through the application of controlled heat will harden the tubing sufficiently so that it will remain flat and pliable and supple for establishing a continuous roll supply thereof and for subsequent manipulation onto a wire end where heat is applied for final curing and shrinking thereof. Accordingly, it is an object of this invention to provide a continuous roll supply of flattened partially cured heat shrink tubing.

The imprinting of indicia onto plastic material is widely employed, and for example typewriters have been used to imprint any desired character upon such tubing, utilizing ribbon or tape with pressure transferable material thereon which is applied by pressure onto said tubing surface. It is an object therefore, to utilize such ribbon or tape in a roll supply thereof, as it is supplied for typewriters heretofore employed to mark such tubing. However, with the present invention the ribbon or tape is transported over a continuous length of tubing, as distinguished from being associated with a multiplicity of short lengths of tubing and each of which must be separately aligned and individually handled.

Printing wheels having embossed characters thereon are of course old in the art, and it is a simple matter to index such a wheel into imprinting position relative to a platen or the like. However, such wheels have not been associated with printing of indicia onto shrink tubing of pre-flattened configuration, nor has such a wheel been used to cut a continuous supply supply of shrink tubing to length. With the present invention, the shrink tubing is disposed between a selected embossed character on the wheel and a platen moveable to pinch the tubing against an intervening tape carrying impressible marking material referred to generally as carbon, ink and/or printing material. This combination advantageously utilizes the collapsed and/or flattened condition of the tubing.

An object of this invention is to provide a continuous supply of shrink tubing in cartridge form to be applied to a portable gun-like mechanism that incrementally advances the same for separate and sequential character impressions. It is another object of this invention to provide a complementary and continuous supply of printing tape in cartridge form to be applied to said portable gun-like mechanism that incrementally advances the same for said separate and sequential character impressions. It is also an object of this invention to associate the aforesaid tubing and tape cartridges into a combined unit for simultaneous installation and/or removal from the operational grip mechanism. With the present invention, the grip mechanism includes all of the mechanical features necessary for selectively imprinting the tubing with material from the tape, and to incrementally advance both the tubing and tape after each imprint; also to cut-off the tubing into length as may be desired. It is to be understood however, that either of the said cartridges can be permanently associated with the grip mechanism and individually loaded with tubing and tape of the color and character required respectively.

It is still another object of this invention to provide a manually operable gun-grip mechanism that sequentially imprints (or cuts) and then advances both the tubing and the tape each time it is operated. A feature is the right angular feed relationship of the tubing and tape, and of the gear driven irreversible ratchet drive that simultaneously advances the tubing and tape subsequent to each character impression or cut-off, also the substantially direct lever action of the platen that imprints the selected wheel characters upon the tubing.

SUMMARY OF INVENTION

This invention relates to a portable shrink tubing marker that is adapted for on-the-job use, to selectively imprint characters onto tubing cut to length as may be required. The shrink tubing of thin wall circular cross section is processed into a flattened form conducive to storage in roll form and to the imprinting of characters thereon when disposed between a platen and the character embossments of an indicia selection wheel or the like. Partial curing of said tubing is by the controlled application of heat while constraining the tubing to a flattened configuration. Imprinting of the tubing is by means of a printing tape from which material is transferred by the application of pressure; the wheel embossments leaving their selected imprint upon the surface of the tubing. The shrink tubing and printing tape are supplied to the grip mechanism in cartridge form, the combination of parts and elements operating to sequentially imprint the wheel characters and to advance both the tubing and tape for the next imprint or cut-off operation. In carrying out this invention, the parts and elements can be pressure molded of plastic, and the dual cartridge or cartridges are expendable, although permanency of said cartridges may be desired.

DRAWINGS

The various objects and features of this invention will be fully understood from the following detailed description of the typical preferred form and application thereof, throughout which description reference is made to the accompanying drawings, in which.

Figure 1:
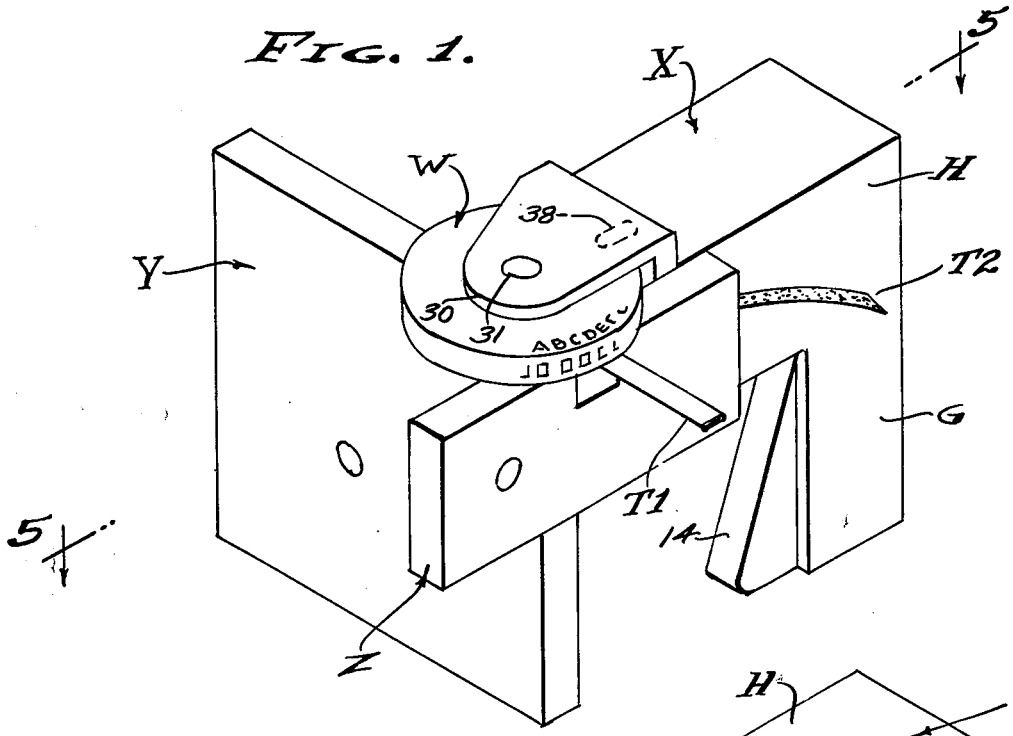
FIG. 1 is a perspective view of the marker gun comprised of the grip mechanism with the dual cartridges installed thereon.
Figure 2:
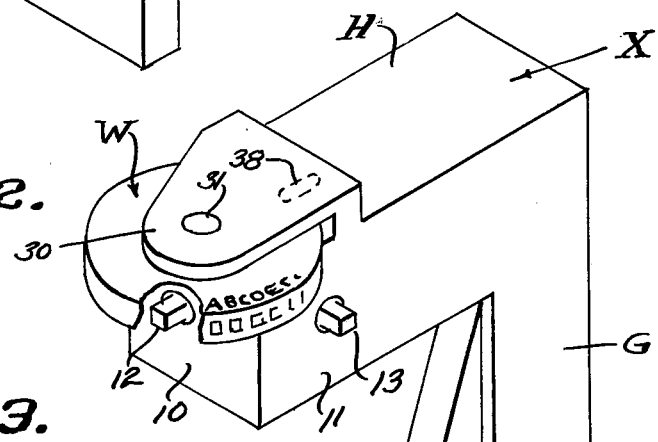
FIG. 2 is a perspective view of the grip mechanism alone.
Figure 3:
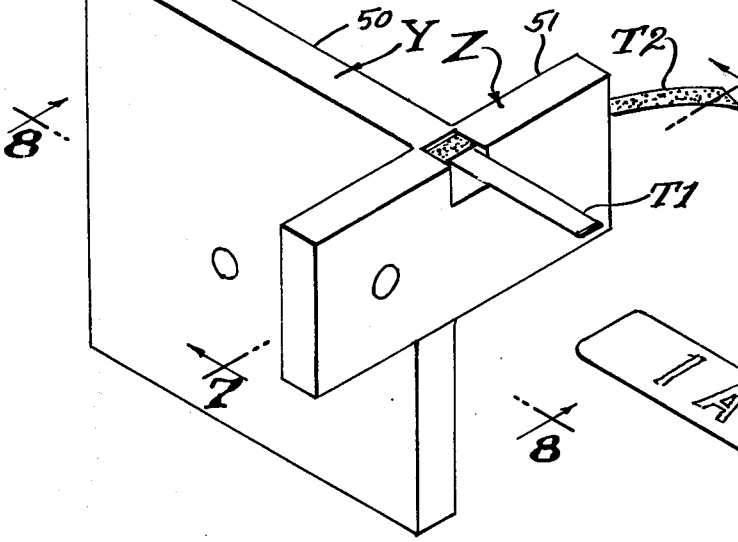
FIG. 3 is a perspective view of the dual cartridges removed from the grip mechanism of FIGS. 1 and 2.
Figure 4:
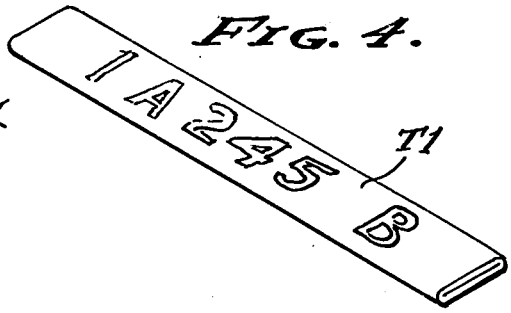
FIG. 4 is an enlarged perspective view of the imprinted tubing product as it is shown issuing in FIG. 1.
Figure 5:
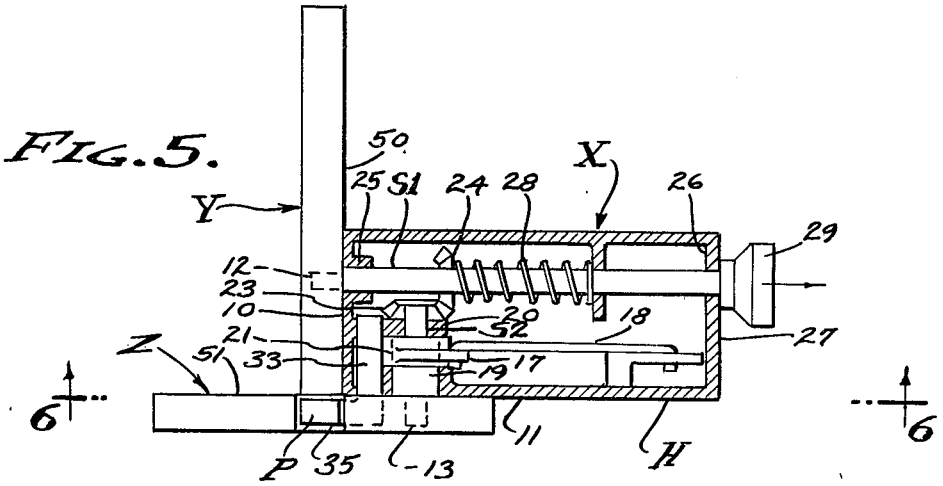
FIG. 5 is a plan section taken as indicated by line 5—5 on FIG. 1.
Figure 7:
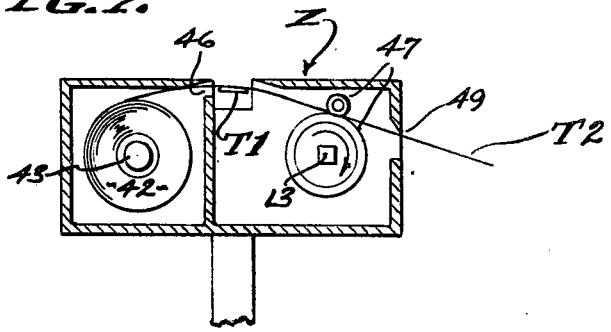
Figure 8:
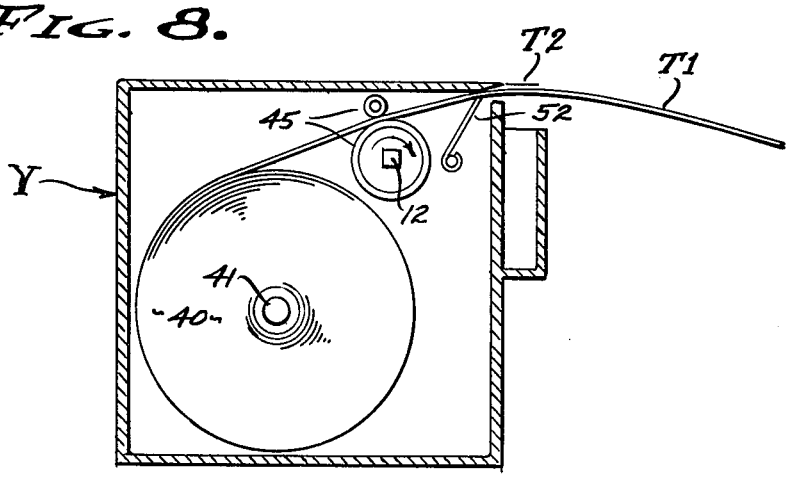

FIGS. 7 and 8 are views of the tape and tubing cartridges respectively and taken as indicated by lines 7—7 and 8—8 on FIG. 3.

Figure 6:
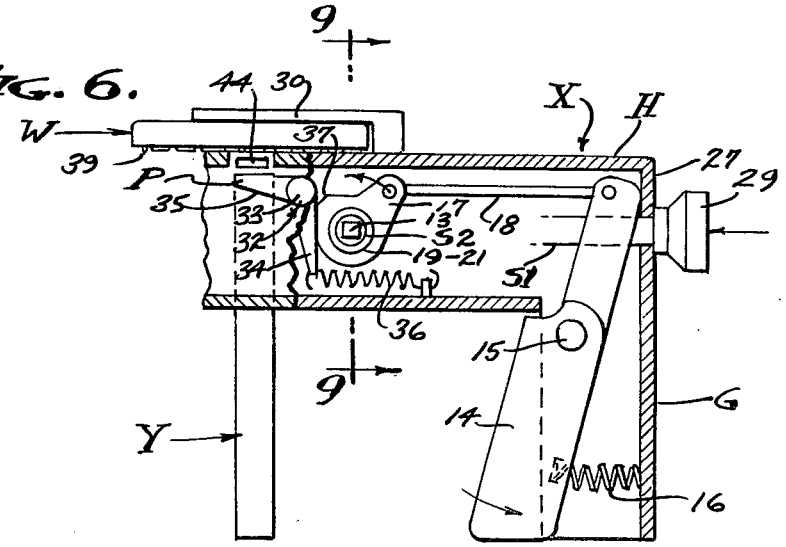
FIG. 6 is a vertical view partially in section and taken substantially as indicated by line 6—6 on FIG. 5.
Figure 9:
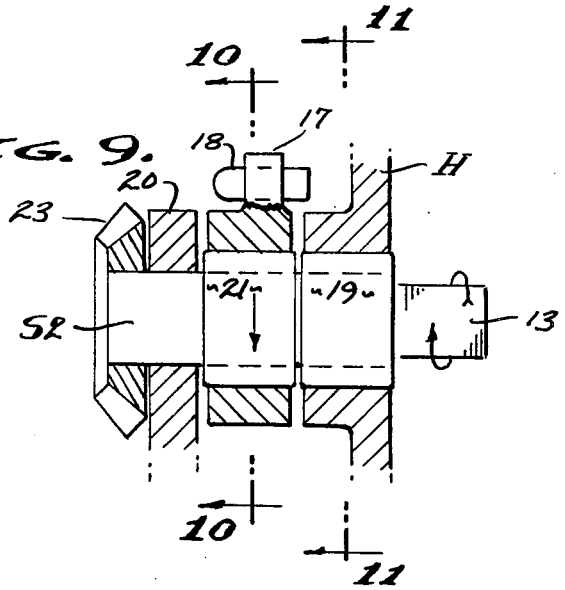
Figure 10:
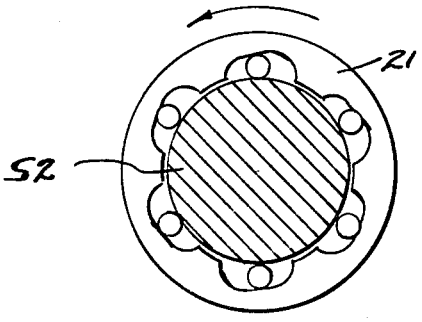
Figure 11:
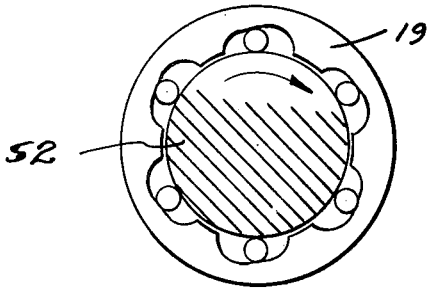

FIG. 9 is an enlarged detailed sectional view of the primary drive shaft taken as indicated by line 9—9 on FIG. 6, and FIGS. 10 and 11 are detailed fragmentary views taken as indicated by lines 10—10 and 11—11 on FIG. 9.

PREFERRED EMBODIMENT

The portable shrink tube marker of the present invention is a hand held device for on-the-job fabrication of identification markers of tube form to be constricted onto wire ends by curing with the application of heat. It is a cross linked polimer tubing in its partially cured state that is employed herein, two examples of which are irradiated and thermally stabilized modified polyvinylidene fluoride or polyolefin compound. The tubing is preformed from its initial circular cross section into a flattened condition by the restricted application of controlled heat that advances the curing thereof for release of a portion of its memory and hardening the same into a constrained flattened configuration. In carrying out this invention, the initial thin walled plastic tubing is immersed in a heated liquid such as water and simultaneously compressed between turning rollers to flatten the same. This method is a continuous process followed by constrainment of the heat shrink tubing in the flattened condition while it cools after removal from the heated liquid, whereby the flattness thereof is retained. In practice, quarter inch tubing having a wall thickness of 0.010 inch is immersed in 200° F. water for a time interval of a few seconds (approximations).

As shown in the drawings there is a pistol grip mechanism X that carries dual cartridges, a tubing cartridge Y and a tape cartridge Z. A feature is the unit combination of cartridges Y and Z that is releasably secured to the grip mechanism X by means of the drive couplings therefor. It is preferred that the cartridge combination Y-Z be expendable and comprised of the essentials for the materials supply associated to be processed by the hand operated mechaism. Accordingly, the flattened shrink tubing T1 issues from the cartridge Y at the head of the grip mchanism X, while the printing tape T2 issues from the cartridge Z across one side of said tubing. That is, the tubing and tape are right angularly related, and the cartridges therefor are right angularly disposed at the head of the grip mechanism, with the tape T2 superimposed over the tubing T1 for impression between a character wheel W and a platen P as will be described. Assuming that the grip mechanism X is an elongated horizontally disposed device, it is preferred that the tubing T1 issue transversely from the cartridge Y disposed in a vertical plane at the front 10 thereof, and that the tape T2 issue longitudinally from the cartridge Z disposed in a vertical plane at the side 11 thereof. The character wheel W and platen P are spaced to openly receive the crossed relationship of tubing and tape, for application to and removal from the grip mechanism. A feature is the coupled attachment of the dual cartridge unit Y-Z to the grip mechanism X, by means of individual drive shafts S1 and S2 that releasably couple with drive rollers to advance the tubing and tape respectively.

Referring now to the pistol grip mechanism X, there is a horizontally disposed housing H that extends forwardly from a depending grip G. In practice, the housing H has the front 10 and side 11 which are right angularly related in vertical planes to receive the aforesaid cartridges Y and Z which are positionably engaged therewith. The drive mechanism comprises the right angularly related drive shafts S1 and S2 with coupling stubs 12 and 13 projecting from the front and side faces respectively, to engage drive rollers in the cartridges Y and Z hereinafter described, one of said coupling stubs being retractile for releasing the dual cartridge combination. The housing H is generally of rectangular formation, and it encloses the drive gearing while providing the bearing support for the right angularly related shafts S1 and S2. The grip G depends from the rear of the housing remote from the front 10, and preferably adjacent to the side 11. As shown, the grip carries a squeeze lever 14 that is rotated on a transverse pivot 15 located at the junction of the housing and grip, there being a compression spring 16 within the grip to press the depending portion of the lever forwardly with respect to said grip. Lever 14 is a first-class lever with its upwardly projecting portion employed to operate the drive mechanism next to be described.

The drive mechanism operates the platen P responsive to manual squeezing of the lever 14, and it simultaneously operates the drive rollers of cartridges Y and Z responsive to the return movement by means of spring 16. Shaft S2 is the main drive shaft that is incrementally advanced upon each return movement of the lever 14, while shaft S1 is geared to said main shaft to rotatably advanced therewith. Drive motion from lever 14 is by means of an ocsillating ratchet drive arm 17 rotatable on shaft S2 and connected to lever 14 by a link 18. Shaft S2 is journaled in the housing H on spaced bearings 19 and 20 and the drive arm 17 is carried on the shaft by an overriding clutch bearing 21 of the Sprague type with rollers free to turn in one direction of rotation and locked against the other direction of rotation. A feature is that one of said bearings 19 or 20 is an overriding clutch bearing of the Sprague type with rollers free to turn in one direction of rotation and not in the other. In carrying out this invention, the shaft clutch bearing 19 (or 20) permits clockwise rotation of shaft S2 when viewed from side 11, while the drive clutch bearing 21 permits counterclockwise rotation of drive arm 17. Accordingly, manual squeezing of the grip lever 14 shifts the drive arm 17 counterclockwise without turning the shaft S2 which is prevented from counterclockwise rotation by shaft clutch bearing 19. However, when the spring 16 returns the lever system, shaft S2 is rotated counterclockwise one increment of movement as determined by the angular displacement of said lever system. Thus, the pair of oppositely acting ratchet clutches prevents back-up and ensures irreversible incremental advancement of the drive shaft S2.

The shaft S1 is the secondary shaft and is driven from the shaft S2 by means of beveled miter gears 23–24 or the like. In practice, the shafts S1 and S2 are revolved at the same rate, as they are associated with the same character size imprinted on the tubing T1 utilizing expendable tape T2. Accordingly, the drive rollers are substantially the same for the tubing and the tape, and the placement of the coupling stubs 12 and 13 is the same for each. That is, the axes of shafts S1 and S2 are in a common plane, the stub 12 being retractile while disengaging the gears 23–24. Accordingly, the shaft S1 is slideably journaled in spaced bearings 25 and 26 with an extension projecting from the rear wall 27 of the housing H. The shaft S1 is biased forwardly by a compression spring 28, and there is a knob 29 thereon engageable for manual withdrawal and turning of the shaft and stub 12. Thus, the stub 12 is retractile for releasing the dual cartridge unit Y-Z, and the shaft can be turned when partially withdrawn so as to disengage the gearing for adjusting the feed position of the tubing T1 issuing from cartridge Y.

Referring now to the character wheel W and the platen P opposed thereto, the head 30 of the housing H projects to carry the wheel W on a vertical axis aligned with the shrink tubing T1 and with the peripheral character embossments thereof aligned with the printing tape T2. Accordingly, there is a wheel shaft 31 spaced from and parallel to the front 10, and the radial position of the characters spaces them from the side 11. It is to be understood that the character embossments include the alphabet, numerals and all symbols that are employed in identifying electrical conductors, there being a detent means 38 to retain the selected rotative position thereof. And, a feature included in the wheel periphery is the sharpened embossment or cut-off blade 39 disposed to extend transversely of the tubing and presenting a knife edge opposing the platen member.

The platen P is on a bell crank 32 with a bearing shaft 33 through the housing side 11 and with angularly related lever arms 34 and 35 to forceably shift the platen P toward the wheel periphery in response to rotation of the drive arm 17. The platen is normally carried a spaced distance below the embossed characters on wheel W, with the tubing T1 juxtaposed to the wheel and with the tape T2 juxtaposed to said platen. A spring 36 biases the arm 35 within the housing to engage a lifting cam 37 turned by arm 17 to actuate the bell crank and platen.

Referring now to the dual cartridge supply of shrink tubing T1 and printing tape T2, the cartridges Y and Z are right angularly related elements that engageably fit the front 10 and side 11 of the housing H. Each cartridge is essentially a box that encloses a wound-up supply of material, the shrink tubing T1 being wound onto a reel 40 supported to turn free on a pin 41, and the printing tape T2 being wound onto a spool 42 supported to turn free on a pin 43. In practice, the tubing cartridge Y is considerably larger than the tape cartridge Z, and both are narrow boxes that lie flat against the housing.

The shrink tubing T1 is completely enclosed within the box of cartridge Y and issues forwardly therefrom at a slot 44 disposed horizontally at the top corner of the housing. Intermediate the reel 40 and slot 44 there is a pair of drive rollers 45 between which the tubing T1 is pinched for driving engagement. The lowermost roller 45 is tyred with resilient friction material and is coupled to the stub 12 of shaft S1 by a polygonal lug and socket fit, for example a squared drive connection. Therefore, as the shaft S1 turns clockwise (viewed from front 10) the roller 45 feeds the shrink tubing T1 forwardly from the slot, and in accordance with this invention the slot 44 issues the tubing above the platen P and spaced below the embossed periphery of the wheel W.

The printing tape T2 is completely encased within the box of cartridge Z and issues laterally therefrom at a slot 46 disposed horizontally at the top corner of the housing. The box of cartridge Z is spaced from the inside of cartridge Y so that the shrink tubing passes by the front face of said tape cartridge. The tape is a ribbon or film and is therefore pulled by a pair of drive rollers 47 between which the tape T2 is pinched for pulling engagement. The rollers 47 are located at the side of the cartridge remote from the slot issuing the tape, and disposed along side the wall 11 of the housing. The lowermost roller 47 is tyred with a resilient friction material and is coupled to the stub 13 of shaft S2 by a polygonal lug and socket fit, for example a squared drive connection. Therefore, as the shaft S2 turns clockwise the rollers 47 pull the printing tape from the slot, and in accordance with this invention the slot 46 issues the printing tape below the embossed periphery of the wheel W and spaced above the platen P.

The cartridges Y and Z are replaceable as shown, and/or expendible. The shrink tubing T1 issues from the slot 44 of cartridge Y in spaced character increments and is severed from the supply thereof in lengths prepared for installation over the end portions of wires to be identified thereby. The printing tape T2 issues from the slot 46 of cartridge Z in slightly spaced character increments and collected upon a take-up spool (not shown) or preferably torn off manually and disposed of. As shown, there is a cutter 49 by which the tape can be readily severes as it feeds from the rollers 47.

From the foregoing it will be seen that the right angularly related cartridges Y and Z present vertically disposed walls 50 and 51 complementary to and engageable with the front 10 and side 11 of the housing H respectively. Retraction of the coupling stub 12 permits the assembly and disassembly of the dual cartridge unit Y-Z with and from the grip mechanism X, and to this end the coupling stub 13 is entered into the socket of roller 47 after which the coupling stub 12 is entered into the roller or reel 40, or vice versa for disassembly. The shaft S1 is partially retracted for disengagement of the gear train so as to enable selective advancement of the shrink tubing when so desired, retraction being prevented by brake spring 52 disposed to permit forward movement of the tubing T1 and with a sharpened edge that digs in upon the application of rearward pressure thereto. Normal imprinting operation is by manual squeezing of the grip G and lever 14 which imprints the selected character, followed by spring retraction of the lever system which incrementally advances both the tubing and the printing tape. As shown, one position of the character wheel W positions a transverse knife that is opposed by the platen P to cut-off lengths of tubing as required.

Having described only a typical preferred form and application of my invention, I do not wish to be limited or restricted to the specific details herein set forth, but wish to reserve to myself any modifications or variations that may appear to those skilled in the art as set forth within the limits of the following claims:

I claim:

1. A portable tubing marker for transferring material from a printing tape and onto said tubing in flattened form, and including; a grip means carrying opposedly shiftable character and platen members and a manually operable lever actuated drive means shifting said members together and having right angularly geared drive and secondary shafts carrying and alternately rotating separate tubing and tape drive rollers, a supply of the flattened tubing engaged with and alternately advanced by said tubing drive roller and issuing therefrom in juxtaposed relation to and above the platen member, and a supply of the printing tape engaged with and alternately advanced by said tape drive roller and issuing therefrom in normal relation over one side of the tubing and in juxtaposed relation to and below the character member, actuation of the drive means opposedly shifting said character and platen members pressing the tape against the tubing for impression of the indicia of the character members thereon.

2. The portable tubing marker as set forth in claim 1, wherein the drive means involves a hand operated lever and said platen member is coupled thereto by a link rotating one bell crank lever on the drive shaft, said crank lever having cam means to shift a second bell crank lever carrying the platen member in opposition to the character member.

3. The portable tubing marker as set forth in claim 1, wherein the tubing drive roller is rotatably advanced by ratchet means on the drive shaft to issue the tubing from the supply thereof.

4. The portable tubing marker as set forth in claim 1, wherein the tape drive roller is rotatably advanced by ratchet means on the drive shaft to issue the printing tape from the supply thereof.

5. The portable tubing marker as set forth in claim 1, wherein the tubing drive roller and the tape drive roller are alternately rotatably advanced by ratchet means on the drive shaft to issue the tubing and printing tape from the supplies thereof respectively.

6. The portable tubing marker as set forth in claim 1, wherein the supply of flattened tubing is a continuous roll supply thereof and the supply of tape is a continuous roll supply thereof, and wherein irreversible ratchet means simultaneously rotatably advances the tubing and tape drive rollers to issue the tubing and tape from the supplies thereof respectively.

7. The portable tubing marker as set forth in claim 1, wherein the character member is a wheel with its periphery embossed with characters and a cut-off blade selectively positionable to oppose the said platen member, wherein the drive means involves a hand operated lever and said platen member is coupled thereto by a link rotating one bell crank lever on the drive shaft, said crank lever having cam means to shift a second bell crank lever carrying the platen member is opposition to the character member, wherein the supply of flattened tubing is a continuous roll supply thereof and the supply of tape is a continuous roll supply thereof, and wherein irreversible ratchet means simultaneously rotatably advances the tubing and tape drive rollers to issue the tubing and tape from the supplies thereof respectively.

8. A portable tubing marker for transferring material from a printing tape and onto said tubing in flattened form, and including; an elongated housing having vertically disposed right angularly related front and side walls and a hand grip depending therefrom remote from the front wall, a selectively positionable character wheel carried on a vertical axis over the housing and with a downwardly disposed periphery embossed with indicia to be selectively positioned adjacent to a corner of the front and side walls of the housing, a shiftable platen carried at said corner of the housing in spaced opposition to said selectively positioned character embossments on the wheel, a cartridge supply of flattened tubing and engageable with the front wall of the housing and said tubing issuing therefrom in juxtaposed relation to and above the platen, a cartridge supply of printing tape and engageable with the side wall of the housing and said tape issuing therefrom in juxtaposed relation to and below the said selectively positioned character embossments on the wheel, and a manually operable drive means shifting the platen toward the selectively positioned character embossments on the wheel and alternately advancing the tubing and tape to issue from their cartridges respectively and comprising a lever actuated by gripping to shift the platen against the tubing for impression of the indicia of the character embossment thereon and by release against spring pressure to incrementally advance the tubing and tape.

9. The portable tubing marker as set forth in claim 8, wherein the character wheel is selectively positionable by detent means.

10. The portable tubing marker as set forth in claim 8, wherein one of the peripheral embossments of the character wheel is a cut-off blade selectively positionable to oppose the said platen member.

11. The portable tubing marker as set forth in claim 8, wherein the drive means is coupled to the platen by a link rotating one bell crank lever to shift a second bell crank lever carrying the platen member in opposition to the character embossments.

12. The portable tubing marker as set forth in claim 8, wherein the drive means comprises a tubing drive member advanced by ratchet means to issue the tubing from the supply thereof.

13. The portable tubing marker as set forth in claim 8, wherein the drive means comprises a tape drive member advanced by ratchet means to issue the printing tape from the supply thereof.

14. The portable tubing marker as set forth in claim 8, wherein the drive means comprises a tubing drive member advanced by ratchet means to issue the tubing from the supply thereof and a tape drive member advanced by ratchet means to issue the printing tape from the supply thereof.

15. The portable tubing marker as set forth in claim 8, wherein the supply of flattened tubing is a continuous roll supply thereof and the drive means comprises a tubing drive roller driveably engaged with said tubing and rotatably advanced by ratchet means to issue the tubing from the supply thereof.

16. The portable tubing marker as set forth in claim 8, wherein the supply of printing tape is a continuous roll supply thereof and the drive means comprises a tape driver roller tractably engaged with said tape and rotatably advanced by ratchet means to issue the tape from the supply thereof.

17. The portable tubing marker as set forth in claim 8, wherein the supply of flattened tubing and the supply of tape are continuous roll supplies thereof and the drive means comprises a tubing drive roller driveably engaged with said tubing and a tape drive roller tractably engaged with said tape, and wherein ratchet means simultaneously advances the tubing and tape drive rollers to issue the tubing and tape from the supplies thereof respectively.

18. The portable tubing marker as set forth in claim 8, wherein the supply of flattened tubing and the supply of tape are continuous roll supplies thereof and the drive means comprises a tubing drive roller driveably engaged with said tubing and a tape drive roller tractably engaged with said tape, and wherein irreversible ratchet means simultaneously advances the tubing and tape driver rollers to issue the tubing and tape from the supplies thereof respectively.

19. The portable tubing marker as set forth in claim 8, wherein one of the peripheral embossments of the character wheel is a cut-off blade selectively positionable to oppose the said platen member, wherein the drive means is coupled to the platen by a link rotating one bell crank lever to shift a second bell crank lever carrying the platen member in opposition to the character embossments, wherein the supply of flattened tubing and supply of tape are continuous roll supplies thereof and the drive means comprises a tubing drive roller driveably engaged with said tubing and a tape drive roller tractably engaged with said tape, and wherein irreversible ratchet means simultaneously advances the tubing and tape drive rollers to issue the tubing and tape from the supplies thereof respectively.

20. A portable tubing marker for transferring material from a printing tape and onto said tubing in flattened form, and including; an elongated housing having vertically disposed right angularly related front and side walls and a hand grip depending therefrom remote from the front wall, a member with selectively positionable character embossments opposedly relatable to a shiftable platen carried adjacent to a corner of the front and side walls of the housing, a cartridge supply of flattened tubing and engageable with the front wall of the housing and said tubing issuing therefrom in juxtaposed relation to and above the platen, a cartridge supply of printing tape and engageable with the side wall of the housing and said tape issuing therefrom in juxtaposed relation to and below the said selectively positioned character emobssments, and a manually operable drive means shifting the platen toward the selectively positioned character embossments and alternately advancing the tubing and tape to issue from their cartridges respectively and comprising, a hand grip lever linked to a ratchet drive arm turning free upon a primary shaft when manually actuated to engage lever means to shift the platen against the tubing for impression of the indicia of the character embossment thereon and locked with said primary shaft when released to rotate said primary shaft to operate means incrementally advancing the printing tape, and a secondary shaft right angularly geared to the primary shaft to turn therewith to simultaneously operate means incrementally advancing the tubing.

21. The portable tubing marker as set forth in claim 20, wherein the primary shaft is irreversibly journaled in the housing with ratchet means free for incrementally advancing said shaft.

22. The portable tubing marker as set forth in claim 20, wherein a cam turned by the ratchet drive arm engages the lever means to shift the platen.

23. The portable tubing marker as set forth in claim 20, wherein the lever means to shift the platen is a bell crank biased by a spring to engage an operating cam turned by the ratchet drive arm.

24. The portable tubing marker as set forth in claim 20, wherein the primary and secondary shafts have drive stubs projecting from the side and front walls of the housing to drivebly engage the means incrementally advancing the printing tape and tubing respectively.

25. The portable tubing marker as set forth in claim 20, wherein the two cartridges are integrally joined as a unit disengageble from the front and side walls of the housing, wherein the primary and secondary shafts have drive stubs projecting from the side and front walls of the housing to driveably engage the means incrementally advancing the printing tape and tubing respectively, and wherein one of said shafts is manually engageable to shift against a spring bias to retract its drive stub and thereby release the cartridge unit from the housing.

26. The portable tubing marker as set forth in claim 20, wherein the two cartridges are integrally joined as a unit disengageable from the front and side walls of the housing, wherein the primary and secondary shafts have drive stubs projecting from the side and front walls of the housing to driveably engage the means incrementally advancing the printing tape and tubing respectively, and wherein the secondary shaft is manually engageable to shift against a spring bias to retract its drive stub and thereby release the cartridge unit from the housing.

27. The portable tubing marker as set forth in claim 20, wherein miter gears rotatably couple the primary and secondary shafts.

28. The portable tubing marker as set forth in claim 20, wherein miter gears rotatably couple the primary and secondary shafts, and wherein the secondary shaft is manually engageable to shift against a spring bias to retract one miter gear from the other.

29. The portable tubing marker as set forth in claim 20, wherein the two cartridges are integrally joined as a unit disengageable from the front and side walls of the housing, wherein miter gears rotatably couple the primary and secondary shafts, and wherein the secondary shaft is manually engageable to shift against a spring bias a short distance to retract one miter gear from the other and a longer distance to retract its drive stub from the cartridge and thereby release the same from the housing.

30. The portable tubing marker as set forth in claim 20, wherein the two cartridges are integrally joined as a unit disengageable from the front and side walls of the housing, wherein the primary and secondary shafts have drive stubs projecting from the side and front walls of the housing to driveably engage the means incrementally advancing the printing tape and tubing respectively, wherein miter gears rotatably couple the primary and secondary shafts, wherein the secondary shaft is manually engageable to shift against a spring bias a short distance to retract one miter gear from the other and a longer distance to retract its drive stub from the cartridge and thereby release the same from the housing, and wherein the lever means to shift the platen is a bell crank biased by a spring means to engage an operating cam turned by the ratchet drive arm.

* * * * *